US010257892B2

(12) United States Patent
Miskin

(10) Patent No.: US 10,257,892 B2
(45) Date of Patent: Apr. 9, 2019

(54) DEVICES AND SYSTEMS HAVING AC LED CIRCUITS AND METHODS OF DRIVING THE SAME

(71) Applicant: Lynk Labs, Inc., Elgin, IL (US)

(72) Inventor: Michael Miskin, Sleepy Hollow, IL (US)

(73) Assignee: Lynk Labs, Inc., Elgin, IL (US)

( * ) Notice: Subject to any disclaimer, the term of this patent is extended or adjusted under 35 U.S.C. 154(b) by 0 days.

(21) Appl. No.: 15/632,906

(22) Filed: Jun. 26, 2017

(65) Prior Publication Data

US 2017/0295616 A1 Oct. 12, 2017

Related U.S. Application Data

(63) Continuation of application No. 14/886,252, filed on Oct. 19, 2015, now Pat. No. 9,693,405, which is a (Continued)

(51) Int. Cl.

| | |
|---|---|
| ***H05B 33/08*** | (2006.01) |
| ***F21S 41/141*** | (2018.01) |
| *F21S 41/19* | (2018.01) |
| *F21S 45/47* | (2018.01) |
| *F21S 43/14* | (2018.01) |

(Continued)

(52) U.S. Cl.

CPC ..... *H05B 33/0821* (2013.01); *F21S 41/141* (2018.01); *H05B 33/083* (2013.01); *H05B 33/089* (2013.01); *H05B 33/0809* (2013.01); *H05B 33/0827* (2013.01); *H05B 33/0884* (2013.01); *H05B 33/0893* (2013.01); *F21S 41/192* (2018.01); *F21S 43/14* (2018.01); *F21S 45/47* (2018.01); *F21Y 2101/00* (2013.01); *F21Y 2115/10* (2016.08)

(58) Field of Classification Search

CPC ..... H05B 33/0815; H05B 33/0818; H05B 37/029; H05B 41/3925; H05B 41/2828; H05B 33/0803

USPC ..... 315/250, 294, 129, 136; 257/43, 98, 88; 361/157

See application file for complete search history.

(56) References Cited

U.S. PATENT DOCUMENTS

| | | | |
|---|---|---|---|
| 3,869,641 | A | 3/1975 | Goldberg |
| 4,218,627 | A | 8/1980 | Kiesel |

(Continued)

FOREIGN PATENT DOCUMENTS

| | | |
|---|---|---|
| EP | 1 215 944 | 6/2002 |
| JP | 08-137429 | 5/1996 |

(Continued)

OTHER PUBLICATIONS

International Search Report and Written Opinion for PCT application No. PCT/US2012/051531, 19 pages.

*Primary Examiner* — Douglas W Owens
*Assistant Examiner* — Syed M Kaiser
(74) *Attorney, Agent, or Firm* — Haynes and Boone, LLP

(57) ABSTRACT

A lighting device and system having at least one circuit, the circuit having at least two LEDs connected in series, parallel or anti-parallel configuration and at least one current limiting diode. The device or system may be driven with AC or DC power and may further include a sensor and polarity switching circuit to utilize all LEDs within the circuit when drive by DC power.

20 Claims, 5 Drawing Sheets

Related U.S. Application Data continuation of application No. 14/239,504, filed as application No. PCT/US2012/051531 on Aug. 20, 2012, now abandoned.

(60) Provisional application No. 61/575,273, filed on Aug. 18, 2011.

(51) Int. Cl.
*F21Y 101/00* (2016.01)
*F21Y 115/10* (2016.01)

(56) References Cited

U.S. PATENT DOCUMENTS 4,298,896 A 11/1981 Okuno
4,535,203 A * 8/1985 Jenkins ..... H02M 7/219 327/424
5,442,258 A * 8/1995 Shibata ..... H05B 33/0809 315/129
5,699,218 A 12/1997 Kadah
5,790,013 A 8/1998 Hauck
6,107,744 A 8/2000 Bavaro et al.
6,614,103 B1 9/2003 Durocher et al.
6,781,570 B1 8/2004 Arrigo et al.
7,489,086 B2 2/2009 Miskin et al.
7,859,196 B2 12/2010 Lee et al.
8,148,905 B2 4/2012 Miskin et al.
8,179,055 B2 5/2012 Miskin et al.
8,531,118 B2 9/2013 Miskin et al.
8,648,539 B2 2/2014 Miskin et al.
8,766,548 B2 * 7/2014 Chew ..... H05B 33/0821 315/192
8,841,855 B2 9/2014 Miskin
2003/0043611 A1 3/2003 Bockle et al.
2003/0122502 A1 7/2003 Clauberg et al.
2003/0169014 A1 9/2003 Kadah
2003/0175004 A1 9/2003 Garito et al.
2004/0080941 A1 4/2004 Jiang et al.
2004/0183380 A1 9/2004 Otake
2004/0189218 A1 9/2004 Leong et al.
2004/0201988 A1 10/2004 Allen
2005/0110426 A1 5/2005 Shao
2005/0173990 A1 8/2005 Anderson et al.
2005/0230600 A1 * 10/2005 Olson ..... H05B 33/0827 250/214.1
2006/0038542 A1 2/2006 Park et al.
2006/0103913 A1 5/2006 Handschy et al.
2006/0138971 A1 6/2006 Uang et al.
2006/0158130 A1 7/2006 Furukawa
2007/0063935 A1 * 3/2007 Yoshida ..... G09G 3/325 345/76
2007/0069663 A1 3/2007 Burdalski et al.
2007/0273299 A1 * 11/2007 Miskin ..... H05B 33/0818 315/250
2008/0062112 A1 * 3/2008 Umezaki ..... G09G 3/342 345/100
2008/0116816 A1 5/2008 Neuman et al.
2008/0136347 A1 6/2008 Lin et al.
2008/0211421 A1 6/2008 Lee et al.
2008/0158915 A1 7/2008 Williams
2008/0203405 A1 8/2008 Rooymans
2008/0203936 A1 8/2008 Mariyama et al.
2008/0218098 A1 9/2008 Lee et al.
2009/0021185 A1 1/2009 Ng
2009/0174337 A1 * 7/2009 Miskin ..... H05B 33/0803 315/250
2009/0295300 A1 12/2009 King
2010/0039794 A1 2/2010 Ghanem et al.
2010/0109558 A1 5/2010 Chew
2010/0224872 A1 9/2010 Kimura
2010/0311494 A1 12/2010 Miller et al.
2011/0210670 A1 9/2011 Sauerlander et al.
2011/0254034 A1 10/2011 Konsek et al.
2011/0284822 A1 11/2011 Jung et al.
2011/0298393 A1 12/2011 Chew
2012/0043897 A1 2/2012 Miskin et al.
2012/0081887 A1 4/2012 Burr et al.
2012/0175643 A1 7/2012 West
2012/0268008 A1 10/2012 Miskin et al.
2012/0293083 A1 11/2012 Miskin et al.
2014/0153232 A1 6/2014 Miskin et al.
2014/0239809 A1 8/2014 Miskin

FOREIGN PATENT DOCUMENTS

JP 11-016683 1/1999
JP 11-330561 11/1999
WO WO 2008124701 10/2008
WO WO 2010138211 12/2010
WO WO 2013082609 6/2013

* cited by examiner

FIG. 1
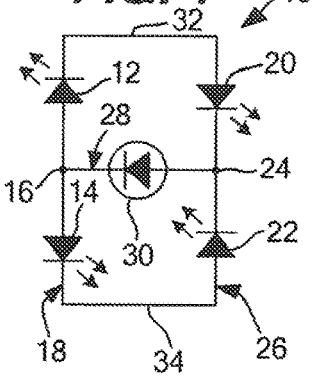
FIG. 2
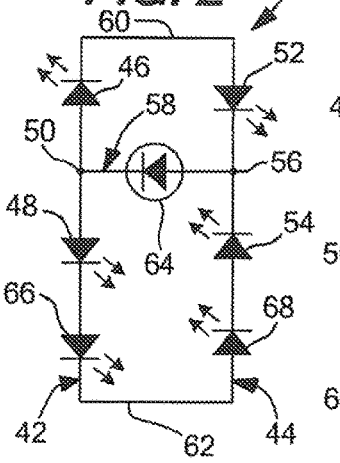
FIG. 3
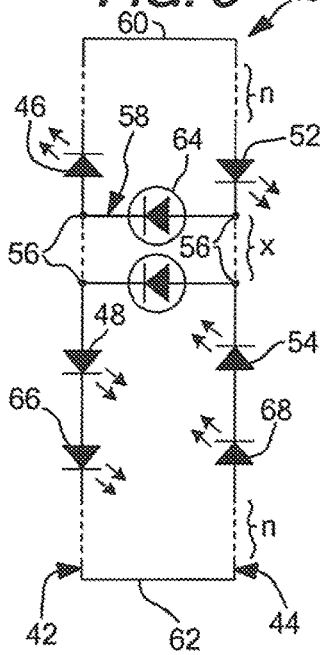
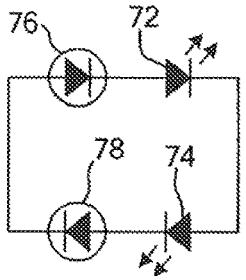
FIG. 4
FIG. 5
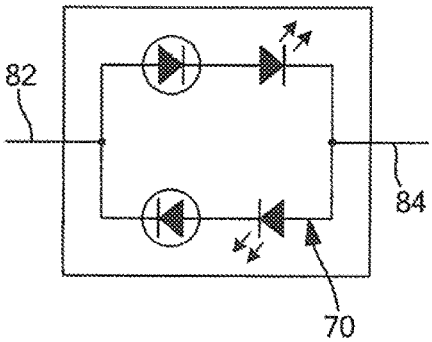
FIG. 6
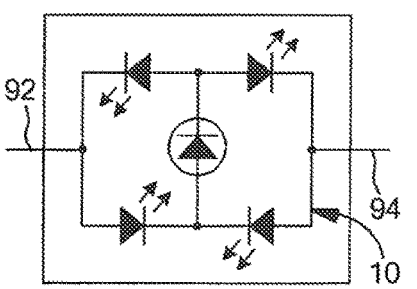

DEVICES AND SYSTEMS HAVING AC LED CIRCUITS AND METHODS OF DRIVING THE SAME

RELATED APPLICATIONS

This application is a continuation of U.S. patent application Ser. No. 14/886,252 filed Oct. 19, 2015, which is a continuation of U.S. patent application Ser. No. 14/239,504 filed Feb. 18, 2014, which is a 371 national phase of International Application No. PCT/US2012/051531 filed Aug. 20, 2012 which claims priority to U.S. Provisional Application No. 61/575,273 filed Aug. 18, 2011—the contents of all of which are expressly incorporated herein by reference.

TECHNICAL FIELD

The present invention generally relates to light emitting diode ("LED") circuits for both AC and DC operation. More specifically, the present invention relates to driving LED circuits, devices, and systems using both AC and DC power, with or without a current limiting element included in the LED circuit.

FEDERALLY SPONSORED RESEARCH OR DEVELOPMENT

None.

BACKGROUND OF THE INVENTION

LEDs are semiconductor devices that produce light when a current is supplied to them. LEDs are intrinsically DC devices that only pass current in one polarity, and historically have been driven by DC power supplies. When driven by DC power supplies, LEDs are typically provided in a string or parallel strings of LEDs which operate in the forward direction such that each LED is continuously operable. Once one LED within a string of LEDs burns out, the entire string will be rendered inoperable and the device containing the string may have to be replaced.

Recent advancements in the field of lighting have led to the use of LED circuits which are capable of using AC power to drive LEDs configured in particular circuit arrangements such that some of the LEDs operate during the positive phase of the AC power cycle and some LEDs operate during the negative phase of the AC power cycle. While this may extend the life of some LEDs within the circuit(s) as they will be turned on or off, flicker may become an issue as the voltage raises up and down, and the other known LED problems are realized.

Whether powered by AC or DC power sources, the amount of current flowing through an LED may dramatically affect the light output of and lifespan of the LED. This is because LEDs emit light based on the amount of current passing through them—the more current that passes through the LED, the brighter the LED will shine. Also, as the current passing through each LED increases, the heat produced by each LED generally increases. Exposure to high or constantly changing heat levels may affect how long an LED will remain operational and reduces efficacy.

In order to control the current flowing through each LED, it is known in the art to place a resistor in series with the LED circuit. While the resistor will provide some current protection in the circuit, it will not prevent the current from reaching higher levels if an increased amount of voltage is applied to the circuit. A resistor will also waste energy and raise heat levels within the circuit. As the voltage applied to the circuit ultimately increases, so will the current and heat within the circuit.

Therefore, it would be advantageous to design a circuit, device, or system utilizing LEDs that limits and controls the current in an LED circuit.

It would also be advantageous to design a circuit, device, or system where AC LED circuits may be used with DC power in a manner which may extend device or system life.

The present invention is provided to solve these and other issues.

SUMMARY OF THE INVENTION

Accordingly, the present invention is directed to a lighting device or system having at least one circuit capable of emitting light when powered by an AC power source. The at least one circuit may include a constant current or current limiting diode in order to substantially maintain a constant and an "upper limit" of current within the circuit, no matter how high the voltage provided by the AC power source gets.

According to one aspect of the invention, a lighting device having at least one circuit capable of emitting light when powered by an AC power source is provided. The circuit may include at least two LEDs connected in a series, a parallel, or an anti-parallel configuration, and at least one current limiting diode connected in series or parallel with at least one of the at least two LEDs. The circuit may be configured in any configuration whereby at least one of the at least two LEDs emits light during a positive phase of provided AC power, and at least one of the at least two LEDs emits light during a negative phase of provided AC power. It is contemplated that the circuit configuration itself may allow for light to be emitted by at least one LED during both the positive and negative phase, or alternatively that a bridge rectifier having diodes, LEDs or a combination thereof, may rectify both the positive and negative phases of the LEDs and provide the rectified power to a string of at least two LEDs.

According to another aspect of the invention, the at least one circuit within the lighting device includes at least first and second branches connecting at first and second common points, the common points providing an input and an output for a driving voltage for the circuit. The first branch of the LED circuit may include at least a first and a second LED connected in opposing series relationship such that the inputs of the first and second LEDs define a first branch junction. Similarly, the second branch may include at least a third and a fourth LED connected in opposing series relationship such that the outputs of the third and fourth LEDs define a second branch junction. The first and second branches connect to one another such that the output of the first LED is connected to the input of the third LED at the first common point, and the output of the second LED is connected to the input of the fourth LED at the second common point. The at least one current limiting diode may be connected in a manner which forms a first cross-connecting circuit branch. The input of the at least one current limiting diode may be connected to the second branch junction while the output may be connected to the first branch junction.

According to another aspect of the invention, the at least one circuit may include at least one additional LED connected in series with each of the second and fourth LEDs than is connected in series with each of the first and third LEDs between each LEDs respective common point and branch junction. Alternatively, one additional LED may be connected in series with each of the first and third LEDs than is connected in series with each of the second and fourth LEDs between each LEDs respective common point and branch junction. The at least one LED circuit may further include n additional LEDs, in pairs, wherein the pairs are configured among the first and second branch circuits of the first circuit such that that the current draw through the first circuit during both AC phases is substantially the same.

According to another aspect of the invention, the at least one LED circuit may include x additional cross-connecting circuit branches. Each cross-connecting circuit branch may have one or more diodes and be connected in parallel to the first cross-connecting circuit branch. The diodes connected in any additional cross-connecting circuit branches may be standard diodes, LEDs or additional current limiting diodes.

According to one aspect of the invention, the lighting device may include at least one circuit having the at least two LEDs connected in an anti-parallel configuration. At least one current limiting diode in the circuit may be connected in series with the anti-parallel LED circuit, or alternatively, at least one current limiting diode may be connected in series with each of the at least two LEDs. At least one additional LED may be connected in series with each anti-parallel LED to form anti-parallel series strings of LEDs. Like an anti-parallel circuit having two LEDs, at least one current limiting diode may be connected in series with both series string of LEDs, i.e. the anti-parallel series strings, or at least one current limiting diode may be connected in series with each series string of LEDs.

According to another aspect of the invention, the lighting device may be powered by a DC power supply or may include a bridge rectifier connected in series with the anti-parallel LEDs so that at least one LED is forward biased by power provided by the DC power supply or bridge rectifier and at least one LED is reverse biased by power provided by the DC power supply or bridge rectifier. The DC power supply or lighting device may further include a load sensor for sensing operation of the at least one forward biased LED. The load sensor, either by itself or using additional TTL logic, switches, relays, and/or circuitry, may be capable of reversing the polarity of the power provided by the bridge rectifier to forward bias the at least one LED that was reversed biased if the sensor fails to detect that the at least one forward biased LED is operating.

According to one aspect of the invention, regardless of what circuit is utilized in the lighting device, the at least one circuit may be integrated into a single chip. The chip may include at least two power connection leads, the power connection leads being connected to opposite sides of the at least one circuit to allow the circuit to connect to an AC or DC power supply.

According to another aspect of the invention, the at least one circuit may be formed by placing individual LED die and at least one current limiting diode on a substrate to form an LED package. The LED may be flip chip or wire bond type LED die. Once on the substrate, the LEDs formed thereon may be coated with phosphor in order to affect the illumination color of the LEDs. Power connection leads may likewise be integrated on the substrate and connected to opposing ends of the at least one circuit formed thereon.

According to yet another aspect of the invention, two or more circuits connected in series or parallel may be formed on a single chip or substrate. When two or more circuits are formed on a single chip or substrate, two power connection leads may be provided and electrically connected to the two or more circuits to enable the two or more circuits to connect to an AC or DC power supply. The circuits may be connected in series, parallel, or series-parallel configurations. Alternatively, the at least two circuits on the chip or substrate may be electrically unconnected and be provided with separate and distinct power connection leads connected at the opposite ends of each circuit, allowing the circuits to be connected in any manner desired or required by an end user.

According to another aspect of the invention, the lighting device may be integrated within a lamp or bulb for use in a lighting system. The lamp may include a base having at least two power connection leads, the power connection leads being capable of connection to the device and at least one circuit so as to be capable of providing power to the at least one circuit from a power source. The lamp may be designed for a specific use, such as general lighting type incandescent replacement lamps and/or a brake light or head light in an automobile. It should be appreciated by those having ordinary skill in the art that any lamp design known in the art may be created utilizing any of the circuits described herein, and that the lamps may be used for any use. Examples of lamps that may be designed using the circuits, chips, packages and other LED devices described herein, include but are not limited to, Edison or E-base type lamps, festoon lamps, bi-pin lamps, or wedge base lamps.

According to one aspect of the invention, a lighting system is provided. The lighting system may include at least one circuit having at least two LEDs electrically connected and configured so that when the LEDs are connected to a DC power source, at least one LED within the circuit is forward biased by the DC power source, and at least one LED within the circuit is reversed biased by the DC power source. For example, the at least two LEDs in the lighting system may be connected in an anti-parallel configuration, however the at least two LEDs may be connected or configured in any manner known in the art, so long as at least one LED is forward biased and at least one LED is reverse biased when the circuit is connected to a DC power source.

The lighting system may also include a load sensor connected to the at least two LEDs. The load sensor may sense the operation of the at least one LED forward biased by the DC power source, and may be capable of reversing the polarity from the DC power source to forward bias the at least one LED previously reverse biased if the operation of the at least one LED which is forward biased fails. Rather than reverse the polarity itself, the load sensor may trip a relay, switch or provide a signal to TTL logic circuits or devices and/or additional circuitry which may reverse the polarity of the DC power provided to the circuit.

In order to provide DC power, the DC power source may include a bridge rectifier for rectifying AC power. The bridge rectifier may be part of the lighting system itself, or may be contained in a driver or external power source or supply. Alternatively, the rectifier may be contained in any lighting devices within the lighting system. The DC power source may also include the load sensor and any circuitry, switches or relays or TTL logic required to dynamically reverse the polarity of the provided DC power should the at least one LED that is forward biased fail.

According to another aspect of the invention, the lighting system may include at least one current limiting diode connected in series with the at least one circuit, or at least one current limiting diode connected in series with each of the at least one LED forward biased by the DC power source and the at least one LED is reversed biased by the DC power source.

According to another aspect of the invention, the at least one circuit in the lighting system may include at least four LEDs configured in a bridge configuration.

According to one aspect of the invention, a method for driving a lighting device or system is provided. At least two LEDs are connected such that at least one of the at least two LEDs is capable of emitting light during a positive phase of power provided by an AC power source, and at least one of the at least two LEDs is capable of emitting light during a negative phase of power provided by an AC power source. Rather than provide AC power, DC power may then be provided to the at least two LEDs. The at least two LEDs form a load on the DC power such that at least one of the at least two LEDs is forward biased and at least one of the at least two LEDs is reversed biased. The polarity of the DC power across the load may then be reversed to forward bias the at least one LED that was previously reverse biased and reverse bias the at least one LED that was previously forward biased in order to use the previously reverse biased LED should, for example, the previously forward biased LED fail.

According to another aspect of the invention, the load output may be monitored or sensed to insure that the at least one LED configured to be forward biased by the DC power is operational and conducting. If the at least one forward biased LED fails and is no longer operational, the polarity of the DC power across the load may be dynamically reversed so as to forward bias the at least one LED that was previously reverse biased. The dynamic reversal of the polarity of the DC power may be done at a DC power supply, may be accomplished using TTL logic devices or circuitry connected to the load within the device or system, or may be accomplished using circuitry connected to the DC power supply and/or load external to the device or system.

According to yet another aspect of the invention, the polarity of the DC power across the load may be reversed manually using a switch capable of controlling the connection between the DC power supply and the at least one load. Manually switching a system switch to an alternate setting may forward bias the at least one LED that was previously reverse biased if the at least one LED previously configured to forward biased is no longer emitting light. It is contemplated by the invention that the switch may be configured to forward bias either LED, regardless of whether either LED has failed. Alternatively, the DC power may be manually reversed by disconnecting the load, i.e. a circuit or device, from the DC power supply, and reconnecting it in a reversed configuration so that the power connection previously connected to ground or the low side of the DC supply is then connected to the high voltage side of the DC supply.

According to another aspect of the invention, the at least two LEDs in the system may be connected in an anti-parallel configuration, and may have at least one current limiting diode in series with the anti-parallel circuit, or may have at least one current limiting diode connected in series with each of the at least two LEDs.

According to another aspect of the invention, at least four diodes may be configured in a bridge configuration in the system. At least two of the at least five diodes may be LEDs with at least one of the at least two LEDs is capable of emitting light when forward biased by the connected DC power, and at least one of the at least two LEDs is reversed biased by the connected DC power.

Other advantages and aspects of the present invention will become apparent upon reading the following description of the drawings and detailed description of the invention.

BRIEF DESCRIPTION OF THE DRAWINGS

FIG. 1 shows a schematic view of a circuit as contemplated by the invention;

FIG. 2 shows a schematic view of a circuit as contemplated by the invention;

FIG. 3 shows a schematic view of a circuit as contemplated by the invention;

FIG. 4 shows a schematic view of a circuit as contemplated by the invention;

FIG. 5 shows a schematic view of a chip as contemplated by the invention;

FIG. 6 shows a schematic view of a chip as contemplated by the invention;

DETAILED DESCRIPTION OF PREFERRED EMBODIMENTS

Figure 7:
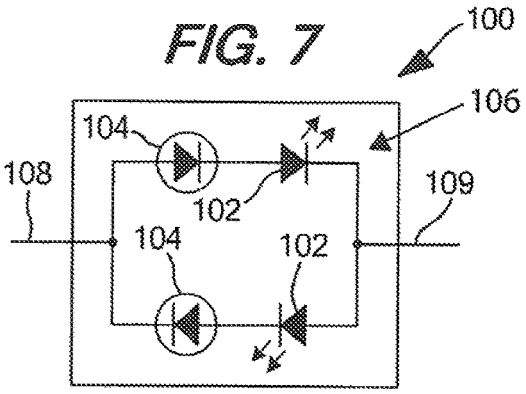
FIG. 7 shows a schematic view of a package as contemplated by the invention.

While this invention is susceptible to embodiments in many different forms, there is described in detail herein, preferred embodiments of the invention with the understanding that the present disclosures are to be considered as exemplifications of the principles of the invention and are not intended to limit the broad aspects of the invention to the embodiments illustrated.

The present invention is directed to a lighting device or system, the light emitting circuits contained therein, and methods of driving and operating the same. As discussed herein, a lighting device may include any device capable of emitting light no matter the intention. Examples of devices which are contemplated by this invention include, but are not limited to, chips, packages, chip on board assemblies, LED assemblies or LED modules. The devices may also include any required power connections or drivers for the circuits emitting light within the device. A lighting system may include multiple such devices, and some or all of the required parts to drive such a device, including but not limited to, power supplies, rectifiers, sensors or light emitting circuitry discussed herein. A system may be, for example, a lamp or light bulb, a portable hand held light unit or indoor and outdoor lighting fixtures. While a lighting device may be incorporated into a lighting system, it is contemplated that any required light emitting elements may be included within the system directly, whether in the form a device as a chip or package, or as circuits within the system.

FIG. 1 discloses an embodiment of a circuit for use in a lighting device or system as contemplated by the invention. Circuit 10 includes LEDs 12, 14 connected at first branch junction 16 in opposing series relationship forming first branch 18, and LEDs 20, 22 connected at second branch junction 24 in an opposing series relationship forming second branch 26. First and second branch junctions 16, 24 are connected by cross-connecting branch 28 which includes current limiting (or constant current) diode 30. The first and second branches also connect at common points 32, 34—LEDs 12, 20 connecting at first common point 32 and LEDs 14, 22 connecting at second common point 34. In this configuration, when AC power is applied to the circuit, current limiting diode 30 is in series with LEDs 12, 22 during one phase (positive or negative) allowing those diodes to emit light. During the opposite AC phase (negative or positive), current limiting diode is in series with LEDs 14, 20, allowing those diodes to emit light. Although only a single cross-connecting branch is shown in FIG. 1, it is contemplated by the invention that any number of cross-connecting branches may be added in parallel to cross-connecting branch 28.

Using current limiting diode 30 as cross-connecting branch 28 insures that the current flowing through circuit 10 during both the positive and negative phase of any provided AC power remains substantially below a threshold level which may adversely affect the life of the LEDs. While a resistor or resistors connected as the cross-connecting circuit or between either common point and the power source may have an effect on the total amount of current flowing through the circuit, i.e. make it less than if no resistor was there, resistors can not prevent the current in the circuit from continually rising with the voltage. Resistors will not create an "upper limit" like a current limiting diode substantially does. A resistor will merely lower the value of the current in the circuit resulting from an applied voltage. In order to reduce the current in the circuit, resistors may also waste energy in the form of heat which can adversely affect the LEDs if contained within a device or system. While some heat and energy may be wasted by the internal resistance of the current limiting diode, the amount may be much less than that of a resistor.

Additionally, using current limiting diode 30 as cross-connecting branch 28 has the advantage of allowing a substantially constant current to flow during both the positive and negative phases as well. A substantially constant current may extend the lifespan of each LED. Inasmuch as the amount of light emitted by an LED is determined by the amount of current flowing through the LED, allowing a substantially constant amount of current through the circuit helps to mitigate any flicker effect caused by the AC voltage cycling. With a current limiting diode, the amount of light emitted by each LED will remain substantially constant during its respective conducting phase. A standard resistor is incapable of maintaining a substantially constant current.

FIGS. 2 and 3 disclose another embodiment of a circuit similar to circuit 10. Similar to circuit 10, circuit 40 includes first and second branches 42, 44 respectively. First branch 42 includes LEDs 46, 48 connected at first branch junction 50 while second branch 44 includes LEDs 52, 54 connected at second branch junction 56. First branch 42 is connected to second branch 44 at common points 60, 62—LEDs 46, 52 connect at common point 60, and LEDs 48, 54 connect at common point 62. Like in circuit 10, cross-connecting branch 58 may include a current limiting diode 64. In order to protect the LEDs within circuit 40 against reverse biasing, as shown in FIGS. 2 and 3, at least one additional LED may be connected in series with LEDs 48, 54 than LEDs 46, 52 between the associated common point and the branch junction or vice versa. As shown in FIG. 2, for example, this is embodied as LED 66 connected in series with LED 48 between branch junction 50 and common point 62 (one more than is connected in series with LED 46 between branch junction 50 and common point 60) and LED 68 connected in series with LED 54 between branch junction 56 and common point 62 (one more than is connected in series with LED 52 between branch junction 56 and common point 60).

As is seen in FIG. 3, any number n of additional LEDs may be added, in pairs in the first and second branches of the circuits such that the current draw through the first circuit during both AC phases is substantially the same. As also seen in FIG. 3, any number x of cross-connecting branches may be added in parallel to cross-connecting branch 58.

FIG. 4 shows yet another embodiment of a circuit as contemplated by this invention. Circuit 70 includes two LEDs, 72, 74 connected in an anti-parallel configuration. Connected in series with each LED is current limiting diode 76, 78 respectively. Connecting a current limiting diode in series with each LED insures that the current flowing through each LED is both substantially limited, and substantially constant, while the combination is forward biased.

It is contemplated by the invention that rather than have just two LEDs connected in an anti-parallel configuration, any number of additional LEDs may be added in series with LEDs 72, 74. In such embodiments, each series string of LEDs may include at least one current limiting diode in order to realize the advantages as discussed herein.

For use as a lighting device or in a lighting device or system, any of the circuits shown or described herein may be integrated on a single chip as shown in FIGS. 5 and 6. Chips 80 and 90 include circuits 70 and 10 respectively, integrated on a single chip. Power connection leads 82, 84 and 92, 94 are provided respectively, at opposing ends of each circuit 70, 10, in order to allow power to be provided thereto. It should be appreciated that circuit 40 in FIGS. 2 and 3 may likewise be integrated on a single chip as shown in FIGS. 5 and 6.

Figure 8:
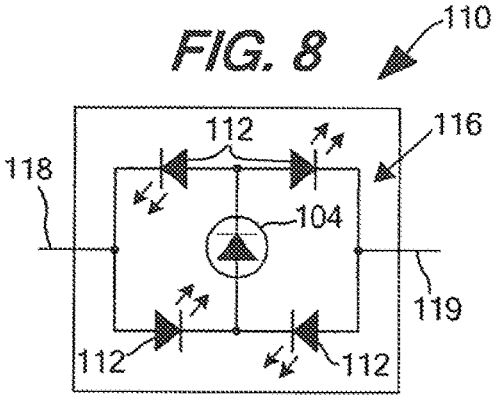
FIG. 8 shows a schematic view of a package as contemplated by the invention.

Rather than integrate on a single chip, it is contemplated by the invention that individual LED die and current limiting LEDs may be placed on a substrate forming a circuit in an LED package as shown in FIGS. 7 and 8. LED packages 100, 110 may include individual LED die 102, 112 and current limiting diodes 104, 114, which may be wire bonded together on substrate 106, 116. Substrate 106, 116 may include, or be attached to, a heat sink forming part of Packages 100, 110. LED packages 100, 110 may further include power connection leads 108, 109 and 118, 119 connected to opposing ends of the formed circuits for connecting the circuits and packages to a driver, power source or the like. Alternatively, rather than have power connection leads extending from each end, packages 100, 110 may be flip chips having power connections located on a bottom surface. As with chips 80, 90, it is contemplated that the circuits shown in FIGS. 2-4 may likewise be formed on a substrate by wire bonding individual LED die and current limiting diodes in the disclosed configuration.

Whether using chips or LED packages formed as described above, using the power connection leads may allow for multiple circuits, chips, and/or packages to be connected together in series, parallel, or series-parallel configurations. In operation, when connecting multiple chips in series or series-parallel, it is advantageous to insure that all current limiting diodes in each circuit in the series are substantially matched. While not required, substantially matching each current limiting diode will insure that each circuit is provided with the amount of current it is designed for. If one current limiting diode in a circuit allows less current than the current limiting diodes connected in series circuits, chips or packages, the amount of current in the series circuits may be less than ideal for those circuits. The light emitted from each circuit may be determined by the lowest value of current limiting diode in the series connection, as this value will substantially determine the current for the entire series.

Figure 9:
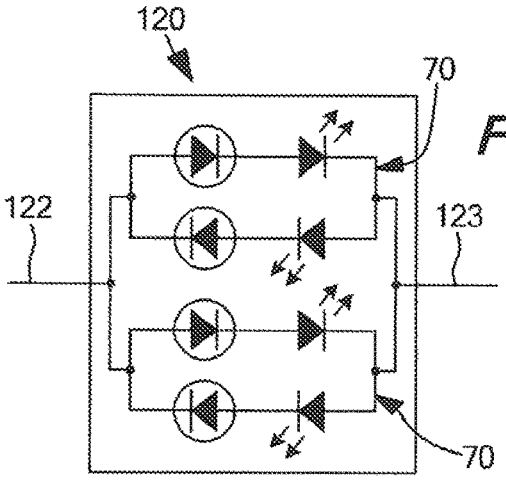
FIG. 9 shows a schematic view of a chip as contemplated by the invention.
Figure 10:
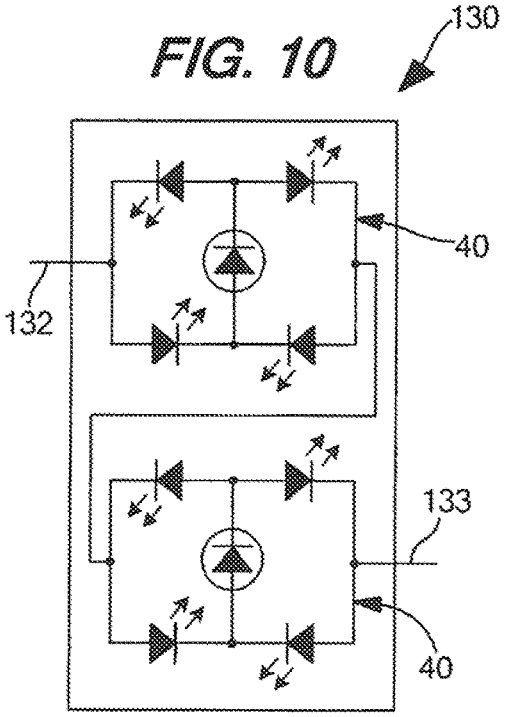
FIG. 10 shows a schematic view of a chip as contemplated by the invention.

As shown in FIGS. 9 and 10, rather than have to connect multiple chips or packages, it is contemplated that multiple circuits may be integrated onto a single chip or multiple circuits may be formed using multiple discrete LED die and current limiting diodes on a single substrate. It is also contemplated that multiple circuits may be formed by using multiple discrete packaged LEDs and current limiting diodes on a single substrate. FIGS. 9 and 10 show chips 120, 130 respectively. Though shown as chips, LED packages may be formed in the same manner as a single circuit package as described above. Chips 120, 130 each include at least two circuits 70, 10 respectively. The individual circuits may be connected in series (as shown in FIG. 10), parallel (as shown in FIG. 9), or where three or more circuits are included in the chip, series-parallel configuration. Power connection leads 122, 123 and 132, 133 may be provided and connected to the circuits as required to create the desired series or parallel configuration.

Figure 11:
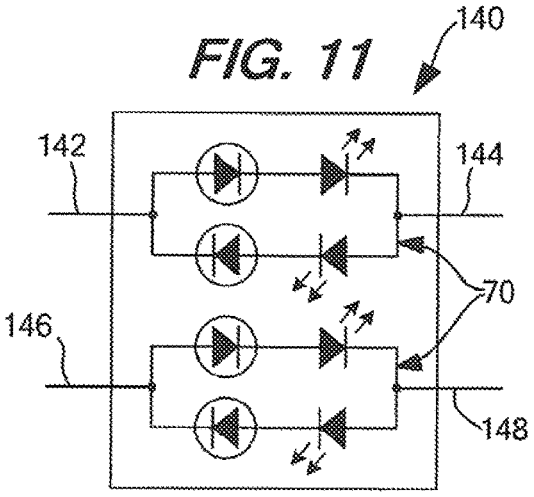
FIG. 11 shows a schematic view of a chip as contemplated by the invention.

Alternatively, as shown in FIG. 11, rather than use a single power lead connection pair for multiple circuits on a single chip or in a single package, each circuit contained on the chip or within the package may be provided with its own power connection leads. As seen in FIG. 11, chip 140 may be provided with at least circuits 70, each circuit having its own power connection lead, 142, 144 and 146, 148. The power connection leads from each circuit may then be connected to any driver or power source for the chip in any manner desired by an end user. For example, circuits 70 may be connected in series with each other at power connection leads 144 and 148 while leads 142 and 146 connect to a power source. Alternatively, circuits 70 may be connected in parallel where leads 142, 144 and 146, 148 all connect to a power source. As additional circuits are added to the single chip or package, the additional circuits may be connected in series or parallel as provided above, depending on the needs or requirements of the system.

Figure 12A:
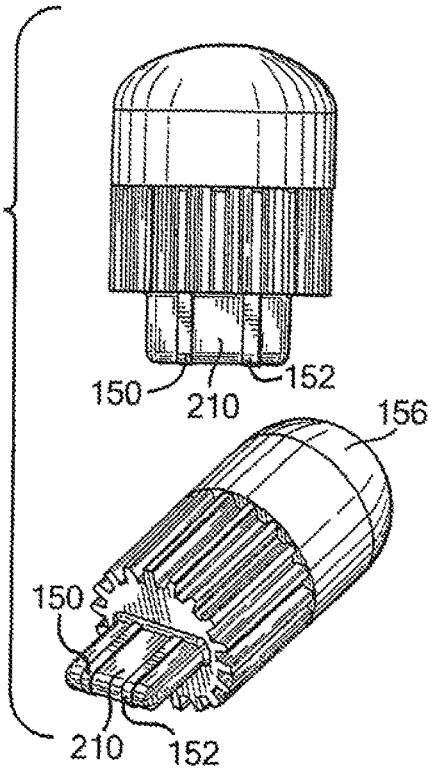
FIG. 12A shows a lighting system as contemplated by the invention.
Figure 12C:
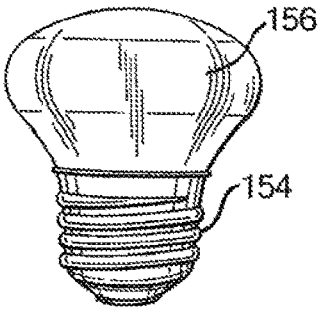
FIG. 12C shows a lighting system as contemplated by the invention.
Figure 12B:
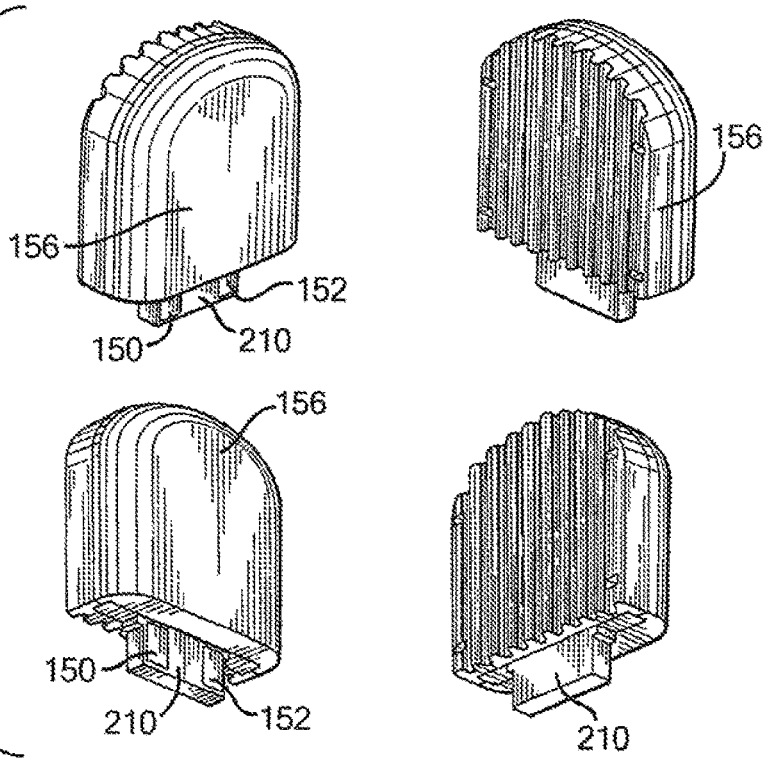
FIG. 12B shows a lighting system as contemplated by the invention.
Figure 12D:
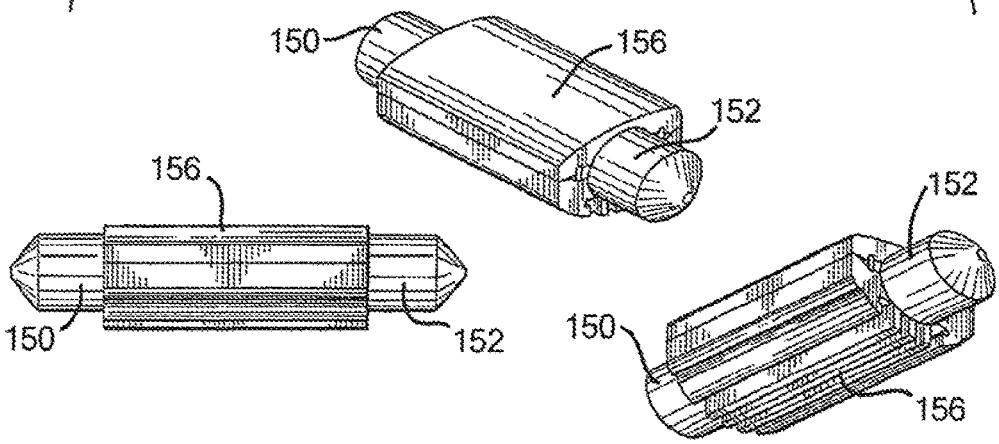
FIG. 12D shows a lighting system as contemplated by the invention.
Figure 12E:
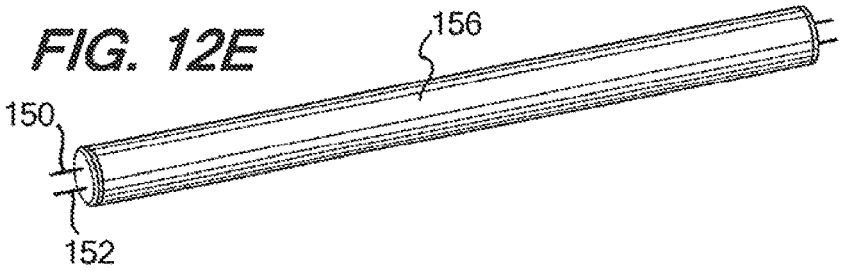
FIG. 12E shows a lighting system as contemplated by the invention.
Figure 13A:
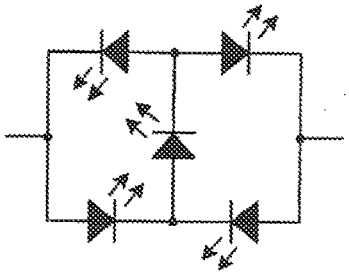
FIG. 13A shows a schematic view of a circuit as contemplated by the invention.
Figure 13C:
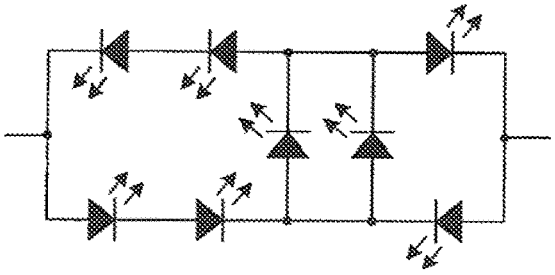
FIG. 13C shows a schematic view of a circuit as contemplated by the invention.
Figure 13B:
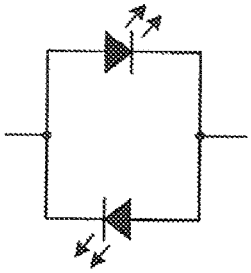
FIG. 13B shows a schematic view of a circuit as contemplated by the invention.
Figure 13D:
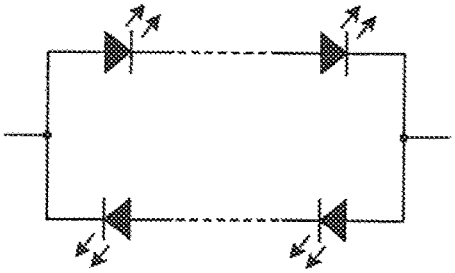
FIG. 13D shows a schematic view of a circuit as contemplated by the invention.

The chips and packages shown and described in FIGS. 5-10 may comprise lighting devices which may be packaged or utilized in a lighting system. As shown in FIGS. 12A-E, the lighting system may be embodied as any form of lamp or light bulb known and used in the art. The lighting device may include two power connection leads (see for example power connection leads 150, 152 in devices FIGS. 12A, 12B, 12D, and 12E) which correspond to the power connection leads on any enclosed chip, package or circuits. Alternatively, the lighting system may include Edison or E-base 154 as shown in FIG. 12C which includes two power connection leads inside the screw base which connects to a lighting fixture, driver or power source. Any lighting circuits, devices, or other required drivers or circuitry may be located within housing 156 of any of the systems shown in FIGS. 12A-E.

While the foregoing has been directed to protecting and enhancing LED circuits which are driven by AC power, it is contemplated by the present invention that the same or similar LED circuits and devices may be driven by DC power. For example, a DC power supply may be connected to common points 32, 34 in FIG. 1 and power connection leads 92, 94 in FIG. 6 so that one combination of LEDs (for example 12, 22 in FIG. 1) is forward biased and one combination of LEDs (for example 14, 20 in FIG. 1) is reverse biased. Likewise, a DC power supply may be connected to circuit 70 in FIG. 4 or power connection leads 82, 84 in FIG. 5 so that one LED (for example 72 in FIG. 4) is forward biased and one LED (for example 74 in FIG. 4) is reverse biased. Where series strings of LEDs are used in anti-parallel circuit 70, the additional LEDs would be forward or reverse biased based upon their configuration and which LED they are connected in series with.

In order to provide DC power to the circuits, it is contemplated by the invention that the circuits or devices may be connected to a DC power source, incorporated into a lighting system using DC power, may be powered from a bridge rectifier or some combination thereof. When DC power is provided by a bridge rectifier, it is contemplated that the bridge rectifier may be incorporated into the lighting device, a lighting system into which the circuit(s) and/or device(s) is incorporated into, or be formed as part of a power supply or driver which is formed in, or connected externally to, the device or system.

If the circuits or devices are connected to a direct DC power supply or incorporated into a system having a direct DC power source, like for example a flashlight or automobile which may use battery power, it may be unnecessary to use current limiting diodes. As such, when being powered with DC power, the circuits shown in FIGS. 13A-D may be substituted for any of the circuits shown in FIGS. 1-4 in any lighting device or system. Inasmuch as a direct DC power supply will provide substantially constant current, the need to limit or maintain the current at a substantially constant level is substantially lessened.

If, however, the DC power is rectified AC power, like for example from the mains, which will have a changing component as the AC power cycles, it may be advantageous to utilize a current limiting diode as shown, for example, in FIGS. 1-4. Utilizing the current limiting diode in the circuits will insure that the rectified DC current remains at a substantially limited level as the AC power cycles, protecting and extending the life of the LEDs as discussed herein.

When connecting any of the devices, circuits, chips, packages, or lamps shown in FIGS. 1-12 to DC power, only one half of the LEDs will emit light, while the remaining LEDs will be reversed biased and not operational. Using the example above, if LEDs 12, 22 in FIG. 1 are forward biased and LEDs 14, 20 are reverse biased or LED 72 is forward biased and LED 74 in FIG. 4 is reverse biased, LEDs 14, 20 and LED 74 will remain off and unused as long as they are reverse biased.

In order to use these LEDs and maximize the lifespan of the circuit, chip, package, lamp or bulb, device or system, it is contemplated by the invention that the polarity of the DC power applied to the circuit, chip, package, lamp or bulb, or device may be reversed to forward bias the previously reverse biased LEDs. Reversing the polarity of the provided DC power will cause the previously reverse biased LEDs to enter into a forward biased state, causing the previously reversed biased and unused LEDs to emit light. The essentially creates a circuit, chip, package, lamp, device or system which has twice the life of an ordinary DC powered LED light as it contains essentially two light emitting elements or circuits within a single circuit, chip, package, lamp, device or system—the first circuit being the first set forward biased LED(s) and the second circuit being the first set of reverse biased LED(s).

In order to take full advantage of this aspect of the invention when utilizing the circuits shown in FIGS. 1-3 for example, it may be desirable to replace the current limiting diode 30 in cross-connecting branch 28 with a common wire. Putting a common wire between the first and second branch junctions will eliminate the possibility the current limiting diode will burnout long before the previously reversed biased LEDs become forward biased after the polarity of the DC power is reversed across the circuit. Inasmuch as the cross-connecting branch must conduct current, i.e. be forward biased, both before and after the DC power polarity is reversed, the lifetime of any type of diode in the cross-connecting circuit will be substantially less than the initially reverse biased diodes once the polarity is reversed.

In order to reverse the DC power provided to the LEDs, where a chip, package, lamp or other device that utilizes power connection leads to establish a clear polarity connection to a power supply, like for example the lamps shown in FIGS. 12A, 12B, 12D and 12E, it is contemplated that the chip, package, lamp or other device may simply be manually disconnected from the DC power source to which it is attached, or from the device or system into which it is incorporated, and reconnected in the reverse polarity configuration. For example, the power connection lead 150, 152 in FIG. 12A, 12B, 12D, or 12E that was initially connected to the negative terminal or ground of the provided DC power may simply be connected to the positive terminal of the DC power source in order to forward bias the previously reversed biased LED(s). Such reversal may be done, for example, in automobile head lights, tail lights or brake lights, or a light within a battery powered hand held lighting device like a flashlight or a lantern by disconnecting the lamp or bulb and replacing it in a reverse fashion.

Rather than have to remove the bulb, chip, package, circuit or device, it is contemplated by the invention that the device or system into which the circuit(s) is incorporated may include a switch or the like capable of connecting the DC power to the load in both a "positive" and a "negative" polarity where "positive" polarity forward biases at least a first LED and reverse biases at least a second LED, and "negative" polarity forward biases at least the second LED and reverses biases at least the first LED. A switch embodiment may be realized as simply as controlling two pairs of switches or relays controlled by a manual external switch, each pair having a switch or relay connected to an opposite end of the circuit, or by using a double pole double throw (DPDT) switch with an off position. Moving the manual external switch to a first position may close a first pair of switches or relays which will create the "positive" polarity while moving the manual external switch to a second position will close a second pair of switches or relays which will create the "negative" polarity. When the first pair of switches or relays are closed the second pair of switches or relays will remain open and vice versa. A third switch position or an off position may leave both pairs of switches or relays open, allowing both the at least first and the at least second LEDs to be off.

When utilizing a switch, if the forward biased LEDs fail and stop emitting light within the device or system, the switch may be moved to a secondary position, or a reverse position, to reverse the polarity of the DC power provided to the LED circuit and forward bias the previously reverse biased LED(s). It is contemplated that during operation, the switch may be moved to any position, allowing either set of LED(s) to be forward biased without waiting for one set to fail. For example, a flashlight may be provided with a switch that when pushed forward from an off position will forward bias a first LED or string of LEDs and reverse bias a second LED or string of LEDs, and when pushed forward further to a second position or backwards from an off position will forward bias the second LED or string of LEDs and reverse bias the first LED or string of LEDs.

Rather than manually switch the circuit, chip, package, lamp, device or system by disconnecting it or using a switch, it is contemplated by the invention that the lighting device or system may include a sensor to monitor or "sense" the load (the circuit or device) and determine whether the circuit (i.e. the forward biased LED(s)) are operational and conducting current. If the sensor determines that the forward biased LED(s) (i.e. the load) is not operational and providing a voltage and/or current, using a signal provided (or not provided) to TTL logic gates, devices or circuits or a microcontroller may control a switch, relay or other circuitry to reverse the polarity of the DC power dynamically and forward bias and the previously reverse biased LED(s). For example, a sensor within the device or system may detect that the forward biased LED(s) are no longer conducting current and provide a signal (or stop providing a signal) to a TTL logic gate or circuit or a microcontroller which may cause a DPDT relay to dynamically change the polarity of power provided to the at least one circuit. The DPDT switching the polarity of the power will cause the previously reverse biased LED(s) to become forward biased and emit light.

Figure 14:
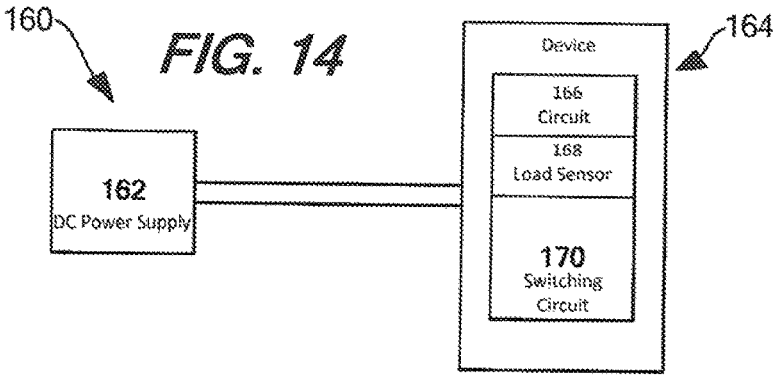
FIG. 14 shows a lighting system as contemplated by the invention.

One example of how a device with an internal sensor and dynamic polarity reversing can be seen in FIG. 14. As seen in FIG. 14, System 160 may include a DC power supply 162 connected to device 164 which includes circuit 166 which may be any circuit discussed herein. In order to detect the operation of the currently forward biased LED(s), load sensor 168 may be included within device 164. So long as load sensor 168 detects that the forward biased LEDs are operational, i.e. conducting current and/or voltage, the polarity of the power provided by the DC power supply will remain the same, and the forward biased diodes will be used to emit light. Once load sensor 168 fails to detect an output from the forward biased LED(s) in circuit 166 (i.e. the LED(s) burnout), load sensor 168 will trigger polarity switching circuit 170 which may include any required logic gates, circuitry or devices, any switches or relays, and/or any other required circuitry, to reverse the polarity of the DC power provided to circuit 166 so that the previously reverse biased LED(s) may be forward biased and begin emitting light. Once the load sensor fails to detect an output from the previously reversed biased LEDs, the lighting device is defective and needs to be replaced.

Figure 15:
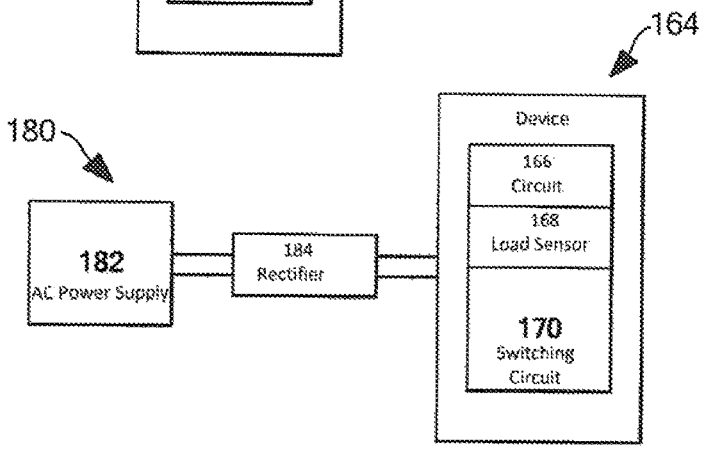
FIG. 15 shows a lighting system as contemplated by the invention.
Figure 16:
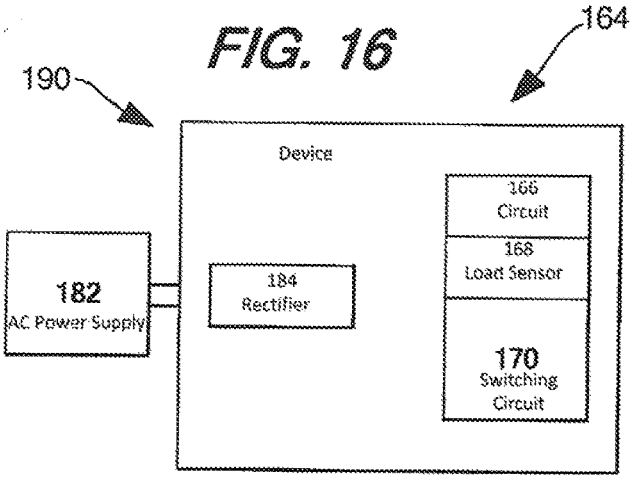
FIG. 16 shows a lighting system as contemplated by the invention.

FIGS. 15 and 16 show alternative embodiment systems 180 and 190 where DC power supply 162 is replaced with an AC power supply 182 and bridge rectifier 184 is used to provide DC power to the device or circuit. As seen in FIG. 15, system 180 may include bridge rectifier 184 which is located external of device 164, between AC power supply 182 and device 164. The AC power provided by AC power supply 182 may be provided to rectifier 184, and the rectified DC power may then be provided on to device 164. Alternatively, as seen in FIG. 16, bridge rectifier 182 may be located internally within device 164. In such embodiments, AC power would be received by device 164 and rectified by rectifier 182 before being provided as DC power to circuit 166.

Figure 17:
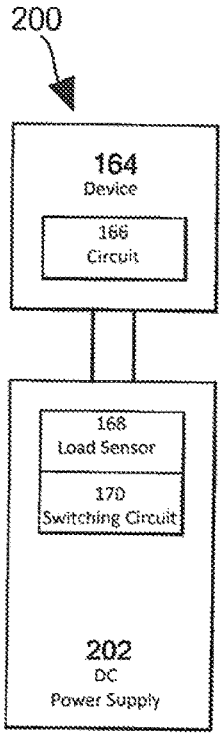
FIG. 17 shows a lighting system as contemplated by the invention.

FIG. 17 shows yet another embodiment, system 200. In system 200, DC power supply or driver 202 may include load sensor 168 and polarity switching circuit 170 internally. The feedback from device 164 may be used to determine whether the forward biased LED(s) in circuit 166 are operational. If the forward biased LED(s) fail, polarity switching circuit 170 may be triggered, and the polarity of the DC power provided to device 164 may be reversed.

Load sensor 168 and polarity switching circuit 170 may be provided within device 164 as a driver, with any additional circuitry required to efficiently drive circuit 166. For example, a driver within device 164 may include bridge rectifier 184 when necessary, as well as any step-up or step-down transformers to adjust an incoming AC voltage. In devices like those show in FIGS. 12A-12E, the driver circuitry may be located within the base (see for example base 210 in FIGS. 12A-E) or housing (see for example housing 156 in FIGS. 12A-E) and integrated in any manner known in the art. The driver may be, for example, a package or chip having any necessary components to connect to the power connection leads of the device and/or any connection leads required to connect to any circuits, chips or packages discussed herein.

While in the foregoing there has been set forth a preferred embodiment of the invention, it is to be understood that the present invention may be embodied in other specific forms without departing from the spirit or central characteristics thereof. The present embodiments, therefore, are to be considered in all respects as illustrative and not restrictive, and the invention is not to be limited to the details given herein. While specific embodiments have been illustrated and described, numerous modifications come to mind without significantly departing from the characteristics of the invention and the scope of protection is only limited by the scope of the accompanying claims.

What is claimed is:

1. A lighting system comprising:

a driver providing a DC output;

at least two LED circuits, each of which includes at least two LEDs, the at least two LED circuits electrically configured so that when the at least two LED circuits are connected to the DC output a first LED circuit of the at least two LED circuits is forward biased by the driver;

a load sensor connected to at least one of the at least two LED circuits, wherein the load sensor senses operation of the first LED circuit forward biased by the driver; and a switching circuit capable of switching the DC output of the driver to forward bias a second LED circuit of the at least two LED circuits based on the operation of the first LED circuit sensed by the load sensor.

2. The lighting system of claim 1 wherein the driver has an AC voltage input from a mains.

3. The lighting system of claim 1, wherein the at least two LEDs are connected in an anti-parallel configuration.

4. The lighting system of claim 2, wherein the DC output of the driver is at least one of a constant DC voltage or a constant current DC output.

5. The lighting system of claim 1, wherein the driver includes a bridge rectifier to rectify power provided by an AC power source.

6. The lighting system of claim 1 further comprising at least one current limiting diode.

7. A method of driving a lighting device or system, the method comprising the steps of:

connecting a first LED circuit of at least two LED circuits to a power source such that the first LED circuit is forward biased by the power source;

sensing at least one of a voltage or a current being delivered to the first LED circuit; and switching a DC output of the power source to forward bias a second LED circuit of the at least two LED circuits if the first LED circuit is determined inoperable based on the at least one of the voltage or the current that is sensed.

8. The method of claim 7 wherein the first LED circuit and the second LED circuit are connected to each other in an anti-parallel configuration.

9. The method of claim 7, wherein the power source is a driver.

10. The method of claim 9, wherein the step of switching the DC output of the power sources comprises:

reversing a polarity of the DC output provided by the power source manually using a switch so as to forward bias the second LED circuit and reverse bias the first LED circuit.

11. The method of claim 9, wherein the step of switching the DC output of the power sources comprises:

reversing a polarity of the DC output provided by the power source by manually disconnecting the second LED circuit from the DC output and reconnecting the second LED circuit to the DC output in a reversed configuration so that the second LED circuit that was previously reverse biased is now forward biased.

12. The method of claim 7, wherein the power source is a driver having an AC voltage input from a mains.

13. The method of claim 12, wherein the DC output of the power source is at least one of a constant DC voltage or a constant current DC output.

14. The method of claim 9, wherein the driver includes a bridge rectifier to rectify power provided by an AC power source.

15. The method of claim 7 further comprising connecting a current limiting diode to at least one of the first LED circuit or the second LED circuit.

16. A method of driving a lighting device or system, the method comprising the steps of:

connecting at least two LEDs such that at least one of the at least two LEDs is capable of emitting light during a positive phase from an AC power source, and at least one of the at least two LEDs is capable of emitting light during a negative phase from an AC power source;

providing DC power across the at least two LEDs, the at least two LEDs forming a load such that a first LED of the at least two LEDs is forward biased by the DC power and a second LED of the at least two LEDs is reversed biased by the DC power;

sensing the load to monitor whether the first LED configured to be forward biased by the DC power is operational; and reversing the polarity of the DC power across the load dynamically so as to forward bias the second LED that was previously reverse biased in response to the first LED being sensed as no longer operational.

17. The method of claim 16, further comprising:

rectifying AC power from the AC power source to provide the DC power.

18. The method of claim 16, further comprising:

connecting a DC output of a driver to the first LED to provide the DC power, wherein the DC output is at least one of a constant DC voltage or a constant current DC output.

19. The method of claim 18, further comprising:

providing an AC voltage input to the driver from a mains.

20. The method of claim 16, wherein connecting the at least two LEDs comprises:

connecting the at least two LEDs in an anti-parallel configuration.

* * * * *